US005786296A

United States Patent [19]

Shustorovich et al.

[11] Patent Number: 5,786,296

[45] Date of Patent: Jul. 28, 1998

[54] THIN-WALLED, MONOLITHIC IRON OXIDE STRUCTURES MADE FROM STEELS

[75] Inventors: Alexander Shustorovich; Eugene Shustorovich, both of Pittsford, N.Y.; Richard Montano, Falls Church, Va.; Konstantin Solntsev, Moscow, Russian Federation; Yuri Buslaev, Moscow, Russian Federation; Sergei Myasoedov, Moscow, Russian Federation; Vyacheslav Morgunov, Moscow, Russian Federation

[73] Assignee: American Scientific Materials Technologies L.P., New York, N.Y.

[21] Appl. No.: 844,239

[22] Filed: Apr. 18, 1997

Related U.S. Application Data

[62] Division of Ser. No. 336,587, Nov. 9, 1994.

[51] Int. Cl.[6] ..... B05J 32/00

[52] U.S. Cl. ..... 502/439; 428/701

[58] Field of Search ..... 428/632, 629, 428/472.2, 701, 702; 148/287; 502/439, 527, 338; 501/87, 112; 29/890, 890.03, 890.08; 55/269; 423/632, 633, 634

[56] References Cited

U.S. PATENT DOCUMENTS

| | | | |
|---|---|---|---|
| 2,201,709 | 5/1940 | Williams et al. | 175/366 |
| 2,205,263 | 6/1940 | Hein | 175/366 |

(List continued on next page.)

FOREIGN PATENT DOCUMENTS

| | | | |
|---|---|---|---|
| 475288 | 7/1951 | Canada | 148/287 |
| 709937 | 6/1954 | United Kingdom | 148/287 |
| 760166 | 10/1956 | United Kingdom | 148/287 |

OTHER PUBLICATIONS

Ipsen et al., Controlled Atmosphere Tempering, reprint from Oct. 1952 Metal Progress, pp. 123–128.

Sittig, M.; Handbook of Toxic and Hazardous Chemicals and Carcinogens, Third Edition: (no month) 1991, vol. 2, G–Z, Noyes Publications: p. 867.

Lewis, Sr., Richard J.; Hazardous Chemicals Desk Reference, Third Edition, (no month) 1993, Van Nostrand Reinhold, pp. 652–653.

OSHA, US Dept of Labor OSHA Regulated Hazardous Substances, Health, Toxicity, Economic and Technological Data, vol. 1, A–1, (no month) 1990: Noyes Data Corporation, pp. 1090–1095.

(List continued on next page.)

*Primary Examiner*—John J. Zimmerman

*Attorney, Agent, or Firm*—Kenyon & Kenyon

[57] ABSTRACT

A thin-walled monolithic iron oxide structure, and process for making such a structure, is disclosed. The structure comprises a monolithic iron oxide structure obtained from oxidizing a thin-walled iron-containing, preferably plain steel, structure at a temperature below the melting point of iron. The preferred wall thickness of the steel is less than about 0.3 mm. The preferred iron oxides of the invention are hematite, magnetite, and combinations thereof. The thin-walled structures of the invention have substantially the same physical shape as the iron starting structure. Thin-walled iron-oxide structures of the invention can be used in a wide variety of applications, including gas and liquid flow dividers, corrosion resistant components of automotive exhaust systems, catalytic supports, filters, thermal insulating materials, and sound insulating materials. Iron oxides of the invention consisting substantially of magnetite can be electrically heated and, therefore, can be applicable in applications such as electrically heated thermal insulation, electric heating of liquids and gases passing through channels, and incandescent devices. Additionally, combination structures using both magnetite and hematite can be fabricated.

2 Claims, 3 Drawing Sheets

U.S. PATENT DOCUMENTS

| | | | |
|---|---|---|---|
| 2,462,289 | 2/1949 | Rochow | 148/287 |
| 2,727,842 | 12/1955 | Vermiji et al. | 148/287 |
| 2,917,419 | 12/1959 | Robinson | 148/6.3 |
| 3,344,925 | 10/1967 | Graham | 210/312 |
| 3,470,067 | 9/1969 | Warren et al. | 195/1.5 |
| 3,505,030 | 4/1970 | Sowards | 23/288 |
| 3,581,902 | 6/1971 | Bidler | 210/347 |
| 3,597,892 | 8/1971 | Farrington | 52/599 |
| 3,630,675 | 12/1971 | Prasky et al. | 23/200 |
| 3,660,173 | 5/1972 | Matsuno et al. | 148/6.35 |
| 3,667,270 | 6/1972 | Deurloo | 72/236 |
| 3,705,057 | 12/1972 | Kelp | 148/287 |
| 3,746,642 | 7/1973 | Bergstrom | 210/446 |
| 3,766,642 | 10/1973 | Schlaudt et al. | 29/420.5 |
| 3,849,115 | 11/1974 | Ban | 75/5 |
| 3,860,450 | 1/1975 | Nicolet et al. | 117/237 |
| 3,892,888 | 7/1975 | Halaby et al. | 427/127 |
| 3,896,028 | 7/1975 | Phillips, Jr. | 210/152 |
| 3,903,341 | 9/1975 | Gerhold | 428/116 |
| 3,930,522 | 1/1976 | Turner | 138/111 |
| 3,945,946 | 3/1976 | Hindin et al. | 252/465 |
| 3,947,502 | 3/1976 | Leitner et al. | 423/632 |
| 3,948,785 | 4/1976 | Berchtold | 252/62.62 |
| 3,948,810 | 4/1976 | Hervert | 252/477 R |
| 3,966,419 | 6/1976 | Bloomfield | 23/288 F |
| 3,975,186 | 8/1976 | Grebe et al. | 75/0.5 AA |
| 3,976,432 | 8/1976 | Schwarz et al. | 23/288 FC |
| 3,980,465 | 9/1976 | Nishida et al. | 75/3 |
| 3,984,229 | 10/1976 | Gorling | 75/3 |
| 3,986,985 | 10/1976 | Dewdney et al. | 252/472 |
| 3,992,330 | 11/1976 | Noakes et al. | 252/466 J |
| 4,006,090 | 2/1977 | Beck | 252/62.56 |
| 4,025,462 | 5/1977 | Cleveland | 252/477 R |
| 4,035,200 | 7/1977 | Valentijn | 148/6.35 |
| 4,042,738 | 8/1977 | Gulati | 428/116 |
| 4,052,326 | 10/1977 | Schöenafinger et al. | 252/62.56 |
| 4,054,443 | 10/1977 | Jaco, Jr. | 75/0.5 AA |
| 4,063,930 | 12/1977 | Kusner et al. | 75/3 |
| 4,070,440 | 1/1978 | Moriguchi | 423/239 |
| 4,118,225 | 10/1978 | Dobo | 75/207 |
| 4,127,691 | 11/1978 | Frost | 428/116 |
| 4,157,929 | 6/1979 | Kubicek | 156/89 |
| 4,162,993 | 7/1979 | Retallick | 252/477 R |
| 4,170,497 | 10/1979 | Thomas et al. | 148/36 |
| 4,170,499 | 10/1979 | Thomas et al. | 148/143 |
| 4,177,307 | 12/1979 | Torii et al. | 428/116 |
| 4,179,412 | 12/1979 | Inaba et al. | 252/472 |
| 4,186,100 | 1/1980 | Mott | 210/496 |
| 4,189,331 | 2/1980 | Roy | 148/6.31 |
| 4,209,412 | 6/1980 | Marcot | 252/62.62 |
| 4,213,959 | 7/1980 | Brodt et al. | 423/634 |
| 4,218,430 | 8/1980 | Biggerstaff | 423/632 |
| 4,221,614 | 9/1980 | Yoda et al. | 148/105 |
| 4,233,169 | 11/1980 | Beall et al. | 252/62.59 |
| 4,247,422 | 1/1981 | Davies | 252/465 |
| 4,259,106 | 3/1981 | Aaltonen et al. | 75/7 |
| 4,264,346 | 4/1981 | Mann | 55/523 |
| 4,273,681 | 6/1981 | Nonnenmann | 252/472 |
| 4,274,029 | 6/1981 | Buxbaum | 313/204 |
| 4,295,818 | 10/1981 | Angwin et al. | 431/7 |
| 4,296,050 | 10/1981 | Meier | 261/112 |
| 4,308,173 | 12/1981 | Fujimori et al. | 252/455 R |
| 4,363,652 | 12/1982 | Kowbuz | 75/0.5 AA |
| 4,364,760 | 12/1982 | Higuchi et al. | 55/523 |
| 4,367,214 | 1/1983 | Sarnecki et al. | 423/634 |
| 4,382,323 | 5/1983 | Chapman et al. | 29/157 R |
| 4,392,991 | 7/1983 | Yannopoulos et al. | 252/466 J |
| 4,395,271 | 7/1983 | Beall et al. | 65/31 |
| 4,400,337 | 8/1983 | Hayashi et al. | 264/82 |
| 4,402,871 | 9/1983 | Retallick | 252/477 R |
| 4,425,250 | 1/1984 | Hibst | 252/62.59 |
| 4,448,833 | 5/1984 | Yamaguchi et al. | 428/116 |
| 4,451,517 | 5/1984 | Inoguchi et al. | 428/116 |
| 4,459,368 | 7/1984 | Jaffee et al. | 502/80 |
| 4,464,352 | 8/1984 | Autzen et al. | 423/634 |
| 4,478,648 | 10/1984 | Zeilinger et al. | 148/6.3 |
| 4,480,051 | 10/1984 | Wu | 502/338 |
| 4,495,074 | 1/1985 | Hagiwara et al. | 210/697 |
| 4,510,261 | 4/1985 | Pereira et al. | 502/304 |
| 4,520,124 | 5/1985 | Abe et al. | 502/159 |
| 4,545,974 | 10/1985 | Thompson | 423/594 |
| 4,550,098 | 10/1985 | Gens | 502/324 |
| 4,576,800 | 3/1986 | Retallick | 422/180 |
| 4,598,062 | 7/1986 | Schneider et al. | 502/306 |
| 4,598,063 | 7/1986 | Retallick | 502/439 |
| 4,664,831 | 5/1987 | Hibst et al. | 252/62.59 |
| 4,668,658 | 5/1987 | Jennings | 502/336 |
| 4,671,827 | 6/1987 | Thomas et al. | 148/12 E |
| 4,673,553 | 6/1987 | Retallick | 422/180 |
| 4,677,839 | 7/1987 | Retallick | 72/402 |
| 4,703,030 | 10/1987 | Khader et al. | 502/338 |
| 4,707,184 | 11/1987 | Hashiguchi et al. | 75/228 |
| 4,711,009 | 12/1987 | Cornelison et al. | 422/180 |
| 4,711,930 | 12/1987 | Hoelderich et al. | 502/209 |
| 4,713,360 | 12/1987 | Newkirk et al. | 501/87 |
| 4,714,497 | 12/1987 | Poncet | 148/6.35 |
| 4,719,090 | 1/1988 | Masaki | 422/310 |
| 4,722,750 | 2/1988 | Saito et al. | 75/5 |
| 4,729,982 | 3/1988 | Thistlethwaite et al. | 502/338 |
| 4,740,408 | 4/1988 | Mochida et al. | 428/116 |
| 4,742,036 | 5/1988 | Flockenhaus et al. | 502/213 |
| 4,743,578 | 5/1988 | Davidson | 502/439 |
| 4,751,212 | 6/1988 | Flockenhaus et al. | 502/338 |
| 4,772,579 | 9/1988 | Thistlethwaite et al. | 502/338 |
| 4,780,213 | 10/1988 | Ogletree | 210/679 |
| 4,782,570 | 11/1988 | Spridco | 29/157 R |
| 4,789,659 | 12/1988 | Maat | 502/328 |
| 4,795,616 | 1/1989 | Mondt et al. | 422/179 |
| 4,797,383 | 1/1989 | Topham | 502/338 |
| 4,798,622 | 1/1989 | Pinguad | 75/0.5 AA |
| 4,810,290 | 3/1989 | Saito et al. | 75/257 |
| 4,810,554 | 3/1989 | Hattori et al. | 428/116 |
| 4,822,660 | 4/1989 | Lipp | 428/113 |
| 4,835,044 | 5/1989 | Hattori et al. | 428/116 |
| 4,845,073 | 7/1989 | Cyron | 502/439 |
| 4,847,225 | 7/1989 | Lussier | 502/68 |
| 4,849,274 | 7/1989 | Cornelison | 428/116 |
| 4,851,375 | 7/1989 | Newkirk et al. | 501/88 |
| 4,853,352 | 8/1989 | Newkirk et al. | 501/88 |
| 4,859,433 | 8/1989 | Pereira et al. | 423/212 |
| 4,869,944 | 9/1989 | Harada et al. | 428/116 |
| 4,870,045 | 9/1989 | Gasper et al. | 502/232 |
| 4,871,693 | 10/1989 | Inoue et al. | 501/9 |
| 4,882,130 | 11/1989 | Asai et al. | 422/310 |
| 4,882,306 | 11/1989 | Kennedy et al. | 501/87 |
| 4,883,420 | 11/1989 | Ozaki et al. | 425/464 |
| 4,884,960 | 12/1989 | Chao | 425/97 |
| 4,891,345 | 1/1990 | Nadkarni et al. | 501/155 |
| 4,898,699 | 2/1990 | Hofmann et al. | 264/43 |
| 4,902,216 | 2/1990 | Cunningham et al. | 425/463 |
| 4,913,980 | 4/1990 | Rowcliffe et al. | 428/6.32 |
| 4,923,109 | 5/1990 | Cyron | 228/181 |
| 4,928,485 | 5/1990 | Whittenberger | 60/299 |
| 4,958,428 | 9/1990 | Humpolik | 29/890 |
| 4,964,926 | 10/1990 | Hill | 148/325 |
| 4,969,265 | 11/1990 | Ehara | 29/890 |
| 4,976,929 | 12/1990 | Cornelison et al. | 422/174 |
| 4,977,129 | 12/1990 | Ernest | 502/330 |
| 4,979,889 | 12/1990 | Frost | 425/192 R |
| 4,985,388 | 1/1991 | Whittenberger | 502/439 |
| 4,999,336 | 3/1991 | Nadkarni et al. | 501/1 |
| 5,001,014 | 3/1991 | Charles et al. | 428/472 |

| | | | |
|---|---|---|---|
| 5,013,232 | 5/1991 | Way | 425/192 R |
| 5,017,526 | 5/1991 | Newkirk et al. | 501/89 |
| 5,021,527 | 6/1991 | Ohmori et al. | 526/245 |
| 5,025,649 | 6/1991 | Retallick | 72/196 |
| 5,051,294 | 9/1991 | Lunkas et al. | 428/184 |
| 5,057,482 | 10/1991 | Fukuda et al. | 502/303 |
| 5,058,381 | 10/1991 | Christenson et al. | 60/299 |
| 5,059,489 | 10/1991 | Buckwalter, Jr. et al. | 428/550 |
| 5,063,769 | 11/1991 | Retallick | 72/379.6 |
| 5,068,218 | 11/1991 | Nishizawa | 502/439 |
| 5,082,700 | 1/1992 | Dwivedi | 428/34.4 |
| 5,089,047 | 2/1992 | Buljan et al. | 75/236 |
| 5,093,178 | 3/1992 | Sundstrom et al. | 428/156 |
| 5,094,906 | 3/1992 | Witzke et al. | 428/220 |
| 5,108,685 | 4/1992 | Kragle | 264/177.12 |
| 5,110,561 | 5/1992 | Hitachi et al. | 422/180 |
| 5,116,659 | 5/1992 | Glatzle et al. | 428/188 |
| 5,118,475 | 6/1992 | Cornelison | 60/300 |
| 5,118,477 | 6/1992 | Takikawa et al. | 422/179 |
| 5,130,208 | 7/1992 | Maus et al. | 428/593 |
| 5,139,844 | 8/1992 | Maus et al. | 428/116 |
| 5,145,822 | 9/1992 | Falke et al. | 502/150 |
| 5,149,508 | 9/1992 | Bullock | 422/174 |
| 5,157,010 | 10/1992 | Maus et al. | 502/439 |
| 5,170,624 | 12/1992 | Cornelison et al. | 60/300 |
| 5,171,503 | 12/1992 | Peters et al. | 264/177.11 |
| 5,174,968 | 12/1992 | Whittenberger | 422/174 |
| 5,180,450 | 1/1993 | Rao | 148/579 |
| 5,183,609 | 2/1993 | Miyahara | 264/44 |
| 5,185,300 | 2/1993 | Hoggard et al. | 502/99 |
| 5,198,006 | 3/1993 | Mimori et al. | 55/523 |
| 5,214,011 | 5/1993 | Breslin | 501/127 |
| 5,217,939 | 6/1993 | Campbell | 502/339 |
| 5,238,886 | 8/1993 | Luszcz et al. | 501/127 |
| 5,240,682 | 8/1993 | Cornelison et al. | 422/174 |
| 5,242,882 | 9/1993 | Campbell | 502/325 |
| 5,244,494 | 9/1993 | Cavanagh | 75/749 |
| 5,244,649 | 9/1993 | Ostertag et al. | 423/633 |
| 5,256,242 | 10/1993 | Imaeda et al. | 156/603 |
| 5,264,294 | 11/1993 | Noel et al. | 428/521 |
| 5,268,339 | 12/1993 | Aghajanian et al. | 501/127 |
| 5,269,926 | 12/1993 | Webster et al. | 210/500.25 |
| 5,272,876 | 12/1993 | Sheller | 60/300 |
| 5,281,462 | 1/1994 | Dav et al. | 428/116 |
| 5,288,345 | 2/1994 | Ohhashi et al. | 148/514 |
| 5,300,234 | 4/1994 | Oechsle et al. | 210/778 |
| 5,314,750 | 5/1994 | Takedoi et al. | 428/402 |
| 5,318,953 | 6/1994 | Hughes | 507/100 |
| 5,330,728 | 7/1994 | Foster | 422/171 |
| 5,332,703 | 7/1994 | Hickman | 501/119 |
| 5,342,431 | 8/1994 | Anderson et al. | 95/45 |
| 5,358,575 | 10/1994 | Nakagawa et al. | 148/287 |
| 5,364,586 | 11/1994 | Trusov et al. | 419/2 |
| 5,370,920 | 12/1994 | Forsythe et al. | 428/131 |
| 5,372,893 | 12/1994 | Usui | 420/593 |
| 5,382,558 | 1/1995 | Inagaki et al. | 502/407 |
| 5,394,610 | 3/1995 | Stoephasius et al. | 148/287 |
| 5,415,772 | 5/1995 | Garcera et al. | 210/232 |
| 5,441,648 | 8/1995 | Lidzey | 210/695 |
| 5,451,245 | 9/1995 | Nomura et al. | 75/348 |
| 5,453,108 | 9/1995 | Isaksson et al. | 55/302 |
| 5,458,437 | 10/1995 | Jaffe et al. | 405/128 |
| 5,468,384 | 11/1995 | Garcera et al. | 210/232 |
| 5,486,220 | 1/1996 | Honda et al. | 55/487 |
| 5,487,771 | 1/1996 | Zeller | 55/523 |
| 5,489,344 | 2/1996 | Martin et al. | 148/284 |
| 5,490,938 | 2/1996 | Sawan et al. | 210/651 |
| 5,496,646 | 3/1996 | Bacigalupo | 428/472.2 |
| 5,497,129 | 3/1996 | Mantese et al. | 333/182 |
| 5,505,903 | 4/1996 | Schrey et al. | 419/64 |
| 5,518,624 | 5/1996 | Filson et al. | 210/651 |
| 5,529,602 | 6/1996 | Ishii et al. | 75/231 |
| 5,545,264 | 8/1996 | Hashimoto | 148/283 |
| 5,643,436 | 7/1997 | Ogawa et al. | 205/324 |

OTHER PUBLICATIONS

German, Randall M., "Fundamentals of Sintering" Engineered Materials Handbook, Ceramics and Glasses, vol. 4, (no month) 1991, ASM International, pp. 260–269.

Haggerty, John S., "Reaction Sintering", Engineered Materials Handbook, Ceramics and Glasses, vol. 4, 1991, ASM International, pp. 291–295.

Bradley, David R., and Samuel Schneider, "The Standardization of Advanced Ceramics" Advanced Ceramic Materials, Society, vol. 3, No. 5, (no month) 1988, pp. 442–448.

Lankford, Jr., William T. et al, "The Making, Shaping and Treating of Steel" Tenth Edition, US Steel, p. 730 (no date).

Ericsson, Torsten, "Principles of Heat Treating of Steels", ASM Handbook, vol. 4—Heat Treating, (no month) 1991, pp. 3–19.

Bramfitt et al. "Annealing of Steel", ASM Handbook, vol. 4—Heat Treating, (no month) 1991, pp. 42–55.

Pradhan, R., "Continuous Annealing of Steel", ASM Handbook, vol. 4—Heat Treating, (no month) 1991, pp. 56–62.

"Basic Heat Treatment", Chapter 10, ASM International 1991, Ferrous Physical Metallurgy (no month) 1991, pp. 403–425.

"Defects in Heat Treated Parts" Chapter 15, ASM International (no month) 1991, Ferrous Physical Metallurgy, pp. 749–791.

THIN-WALLED, MONOLITHIC IRON OXIDE STRUCTURES MADE FROM STEELS

This application is a division of application Ser. No. 08/336,587, filed on Nov. 9, 1994.

FIELD OF THE INVENTION

This invention relates to thin-walled monolithic iron oxide structures made from steels, and methods for manufacturing such structures by heat treatment of steels.

BACKGROUND OF THE INVENTION

Thin-walled monolithic structures, combining a variety of thin-walled shapes with the mechanical strength of monoliths, have diverse technological and engineering applications. Typical applications for such materials include gas and liquid flow dividers used in heat exchangers, mufflers, catalytic carriers used in various chemical industries and in emission control for vehicles, etc. In many applications, the operating environment requires a thin-walled monolithic structure which is effective at elevated temperatures and/or in corrosive environments.

In such demanding conditions, two types of refractory materials have been used in the art, metals and ceramics. Each suffers from disadvantages. Although metals can be mechanically strong and relatively easy to shape into diverse structures of variable wall thicknesses, they typically are poor performers in environments including elevated temperatures or corrosive media (particularly acidic or oxidative environments). Although many ceramics can withstand demanding temperature and corrosive environments better than many metals, they are difficult to shape, suffer diminished strength compared to metals, and require thicker walls to compensate for their relative weakness compared to metals. In addition, chemical processes for making ceramics often are environmentally detrimental. Such processes can include toxic ingredients and waste. In addition, commonly used processes for making ceramic structures by sintering powders is a difficult manufacturing process which requires the use of very pure powders with grains of particular size to provide desirable densification of the material at high temperature and pressure. Often, the process results in cracks in the formed structure.

Metal oxides are useful ceramic materials. In particular, iron oxides in their high oxidation states, such as hematite ($\alpha$-$Fe_2O_3$) and magnetite ($Fe_3O_4$) are thermally stable refractory materials. For example, hematite is stable in air except at temperatures well in excess of 1400° C., and the melting point of magnetite is 1594° C. These iron oxides, in bulk, also are chemically stable in typical acidic, basic, and oxidative environments. Iron oxides such as magnetite and hematite have similar densities, exhibit similar coefficients of thermal expansion, and similar mechanical strength. The mechanical strength of these materials is superior to that of ceramic materials such as cordierite and other aluminosilicates. Hematite and magnetite differ substantially in their magnetic and electrical properties. Hematite is practically non-magnetic and non-conductive electrically. Magnetite, on the other hand, is ferromagnetic at temperatures below about 575° C. and is highly conductive (about $10^6$ times greater than hematite). In addition, both hematite and magnetite are environmentally benign, which makes them particularly well-suited for applications where environmental or health concerns are important. In particular, these materials have no toxicological or other environmental limitations imposed by U.S. OSHA regulations.

Metal oxide structures have traditionally been manufactured by providing a mixture of metal oxide powders (as opposed to metal powders) and reinforcement components, forming the mass into a desired shape, and then sintering the powder into a final structure. However, these processes bear many disadvantages including some of those associated with processing other ceramic materials. In particular, they suffer from dimensional changes, generally require a binder or lubricant to pack the powder to be sintered, and suffer decreased porosity and increased shrinkage at higher sintering temperatures.

Use of metal powders has been reported for the manufacture of metal structures. However, formation of metal oxides by sintering metal powders has not been considered desirable. Indeed, formation of metal oxides during the sintering of metal powders is considered a detrimental effect which opposes the desired formation of metallic bonds. "Oxidation and especially the reaction of metals and of nonoxide ceramics with oxygen, has generally been considered an undesirable feature that needs to be prevented." Concise Encyclopedia of Advanced Ceramic Materials, R. J. Brook, ed., Max-Planck-Institut fur Metalforschung, Pergamon Press, pp. 124–25 (1991).

In the prior art, it has been unacceptable to use steel starting materials to manufacture uniform iron oxide monolithic structures, at least in part because oxidation has been incomplete in prior art processes. In addition, surface layers of iron oxides made according to prior art processes suffer from peeling off easily from the steel bulk.

Heat treatment of steels often has been referred to as annealing. Although annealing procedures are diverse, and can strongly modify or even improve some steel properties, the annealing occurs with only slight changes in the steel chemical composition. At elevated temperatures in the presence of oxygen, particularly in air, carbon and low alloy steels can be partially oxidized, but this penetrating oxidation has been universally considered detrimental. Such partially oxidized steel has been deemed useless and characterized as "burned" in the art, which has taught that "burned steel seldom can be salvaged and normally must be scrapped." "The Making, Shaping and Testing of Steel," U.S. Steel, 10th ed., Section 3, p. 730. "Annealing is [ ] used to remove thin oxide films from powders that tarnished during prolonged storage or exposure to humidity." Metals Handbook, Vol. 7, p. 182, Powder Metallurgy, ASM (9th Ed. 1984).

One attempt to manufacture a metal oxide by oxidation of a parent metal is described in U.S. Pat. No. 4,713,360. The '360 patent describes a self-supporting ceramic body produced by oxidation of a molten parent metal to form a polycrystalline material consisting essentially of the oxidation reaction product of the parent metal with a vapor-phase oxidant and, optionally, one or more unoxidized constituents of the parent metal. The '360 patent describes that the parent metal and the oxidant apparently form a favorable polycrystalline oxidation reaction product having a surface free energy relationship with the molten parent metal such that within some portion of a temperature region in which the parent metal is molten, at least some of the grain intersections (i.e., grain boundaries or three-grain-intersections) of the polycrystalline oxidation reaction product are replaced by planar or linear channels of molten metal.

Structures formed according to the methods described in the '360 patent require formation of molten metal prior to oxidation of the metal. In addition, the materials formed according to such processes does not greatly improve strength as compared to the sintering processes known in the art. The metal structure originally present cannot be maintained since the metal must be melted in order to form the metal oxide. Thus, after the ceramic structure is formed, whose thickness is not specified, it is shaped to the final product.

Another attempt to manufacture a metal oxide by oxidation of a parent metal is described in U.S. Pat. No. 5,093,178. The '178 patent describes a flow divider which it states can be produced by shaping the flow divider from metallic aluminum through extrusion or winding, then converting it to hydrated aluminum oxide through anodic oxidation while it is slowly moving down into an electrolyte bath, and finally converting it to α-alumina through heat treatment. The '178 patent relates to an unwieldy electrochemical process which is expensive and requires strong acids which are corrosive and environmentally detrimental. The process requires slow movement of the structure into the electrolyte, apparently to provide a fresh surface for oxidation, and permits only partial oxidation. Moreover, the oxidation step of the process of the '178 patent produces a hydrated oxide which then must be treated further to produce a usable working body. In addition, the description of the '178 patent is limited to processing aluminum, and does not suggest that the process might be applicable to iron. See also, "Directed Metal Oxidation," in *The Encyclopedia of Advanced Materials*, vol. 1, pg. 641 (Bloor et al., eds., 1994).

Accordingly, there is a need for iron oxide monolithic structures which are of high strength, efficiently and inexpensively manufactured in environmentally benign processes, and capable of providing refractory characteristics such as are required in demanding temperature and chemical environments. There also is a need for iron oxide monolithic structures which are capable of operating in demanding environments, and having a variety of shapes and wall thicknesses.

OBJECTS AND SUMMARY OF THE INVENTION

In light of the foregoing, it is an object of the invention to provide an iron oxide monolithic structure which has high strength, is efficiently manufactured, and is capable of providing refractory characteristics such as are required in demanding temperature and chemical environments. It is a further object of the invention to provide iron oxide monolithic structures which are capable of operating in demanding environments, and having a variety of shapes and wall thicknesses. It is a further object of the invention to obtain iron oxide structures directly from plain steel structures, and to retain substantially the physical shape of the steel structure.

These and other objects of the invention are accomplished by a thin-walled iron oxide structure manufactured by providing a monolithic iron-containing metal structure (such as a steel structure), and heating the iron-containing metal structure at a temperature below the melting point of iron to oxidize the iron-containing structure and directly transform the iron to iron oxide, such that the iron oxide structure retains substantially the same physical shape as the iron-containing metal structure. In one embodiment of the invention, a thin-walled iron oxide structure is manufactured by providing a monolithic iron-containing metal structure (such as a steel structure), and heating the iron-containing metal structure at a temperature below the melting point of iron to oxidize the iron-containing structure and directly transform the iron to hematite, and then to de-oxidize the hematite structure into a magnetite structure. The iron oxide structures of the invention can be made directly from ordinary steel structures, and will substantially retain the shape of the ordinary steel structures from which they are made.

Thin-walled iron-oxide structures of the invention can be used in a wide variety of applications, including flow dividers, corrosion resistant components of automotive exhaust systems, catalytic supports, filters, thermal insulating materials, and sound insulating materials. An iron oxide structure of the invention containing predominantly magnetite, which is magnetic and electrically conductive, can be electrically heated and, therefore, can be applicable in applications such as electrically heated thermal insulation, electric heating of liquids and gases passing through channels, and incandescent devices which are stable in air. Additionally, combination structures using both magnetite and hematite could be fabricated. For example, the materials of the invention could be combined in a magnetite heating element surrounded by hematite insulation.

DETAILED DESCRIPTION OF THE PREFERRED EMBODIMENTS

Figure 1:
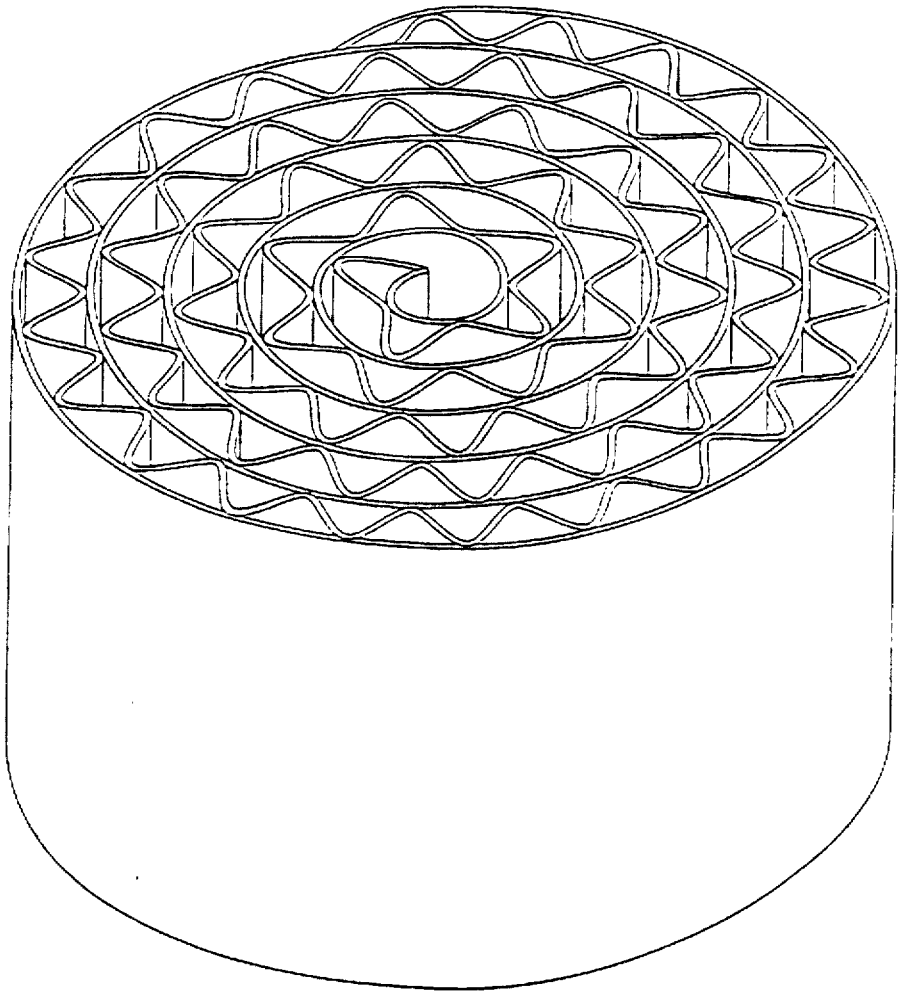
FIG. 1 is a plan view of an exemplary steel structure shaped as a cylindrical flow divider and useful as a starting material for fabricating iron oxide structures of the invention.

The present invention relates to the direct transformation of structures made from iron-containing materials, such as thin plain steel foils, ribbons, gauzes, wires, etc., into structures made from iron oxide, such as hematite, magnetite and combinations thereof. The wall thickness of the starting iron-containing structure is important, preferably less than about 0.6 mm, more preferably less than about 0.3 mm, and most preferably less than about 0.1 mm. The process for carrying out such a transformation comprises forming an iron-containing material into a desired structural shape, and then heating the iron-containing structure to a temperature below the melting point of iron to form an iron oxide structure having substantially the same shape as the iron-containing starting structure. Oxidation preferably occurs well below the melting point of iron, which is about 1536° C. Formation of hematite structures preferably occurs in air at about 725° to about 1350° C., and more preferably at about 800° to about 1200° C.

Although magnetite structures can be made by direct transformation of iron-containing structures to magnetite structures, magnetite structures most preferably are obtained by de-oxidizing hematite structures by heating in air at a temperature of about 1420° to about 1550° C. The processes of the invention are simple, efficient, and environmentally benign in that they contain no toxic substituents and create no toxic waste.

One significant advantage of the present invention is that it can use relatively cheap and abundant starting materials such as plain steel for the formation of iron oxide structures. As used in this application, plain steel refers to alloys which comprise iron and less than about 2 weight percent carbon, with or without other substituents which can be found in steels. In general, any steel or other iron-containing material which can be oxidized into iron oxide by heat treatment well below the melting point of iron metal is within the scope of the present invention.

It has been found that the process of the invention is applicable for steels having a broad range of carbon content, for example, about 0.04 to about 2 weight percent. In particular, high carbon steels such as Russian Steel 3, and low carbon steels such as AISI-SAE 1010, are suitable for use in the invention. Russian Steel 3 contains greater than about 97 weight percent iron, less than about 2 weight percent carbon, and less than about 1 weight percent of other elements (including about 0.3 to about 0.7 weight percent manganese, about 0.2 to about 0.4 weight percent silicon, about 0.01 to about 0.05 weight percent phosphorus, and about 0.01 to about 0.04 weight percent sulfur). AISI-SAE 1010 contains greater than about 99 weight percent iron, about 0.08 to about 0.13 weight percent carbon, about 0.3 to about 0.6 weight percent manganese, about 0.4 weight percent phosphorous, and about 0.05 weight percent sulfur.

To enhance the efficiency and completeness of the transformation of the starting material to iron oxide, it is important that the initial structure be sufficiently thin-walled. It is preferred that the starting structure be less than about 0.6 mm thick, more preferably less than about 0.3 mm thick, and most preferably less than about 0.1 mm thick. The starting material can take virtually any suitable form desired in the final product, such as thin foils, ribbons, gauzes, meshes, wires, etc. Significantly, it is not necessary for any organic or inorganic binders or matrices to be present to maintain the oxide structures formed during the process of the invention. Thus, the thermal stability, mechanical strength, and uniformity of shape and thickness of the final product can be greatly improved over products incorporating such binders.

Plain steel has a density of about 7.9 $gm/cm^3$, while the density of hematite and magnetite are about 5.2 $gm/cm^3$ and about 5.1 $gm/cm^3$, respectively. Since the density of the steel starting material is higher than for the iron oxide product, the iron oxide structure walls typically will be thicker than the walls of the starting material structure, as is illustrated by the data provided in Table I of Example 1 below. The oxide structure wall typically also contains an internal gap whose width correlates with the wall thickness of the starting structure. It has been found that thinner-walled starting structures generally will have a smaller internal gap after oxidation as compared to thicker-walled starting structures. For example, as seen from Table I in Example 1, the gap width was 0.04 and 0.015 mm, respectively, for iron oxide structures made from foils of 0.1 and 0.025 mm in thickness.

It is particularly preferred that a maximum amount of the surface area of the structure be exposed to the oxidative atmosphere during the heating process for hematite formation. In one preferred embodiment of the invention, the starting structure is a cylindrical steel disk shaped as a flow divider, such as is depicted in FIG. 1. Such a flow divider can be useful, for example, as an automotive catalytic converter. Typically, the disk comprises a first flat sheet of steel adjacent a second corrugated sheet of steel, forming a triangular cell (mesh), which are rolled together to form a disk of suitable diameter. The rolling preferably is tight enough to provide physical contact between adjacent sheets. Alternatively, the disk could comprise three adjacent sheets, such as a flat sheet adjacent a first corrugated sheet which is adjacent a second corrugated sheet, with the corrugated sheets having different triangular cell sizes.

The size of the structures which can be formed in most conventional ceramic processes is limited. However, there are no significant size limitations for structures formed with the present invention. For example, steel flow dividers of such construction which are useful in the invention can vary based on the furnace size, finished product requirements and other factors. Steel flow dividers can range, for example, from about 50 to about 100 mm in diameter, and about 35 to about 75 mm in height. The thickness of the flat sheets is about 0.025 to about 0.1 mm, and the thickness of the corrugated sheets is about 0.025 to about 0.3 mm. The triangular cell formed by the flat and corrugated sheets in such exemplary flow dividers can be adjusted to suit the particular characteristics desired for the iron oxide structure to be formed, depending on the foil thickness and the design of the equipment (such as a tooth roller) used to form the corrugated sheets. For example, for 0.1 mm to 0.3 mm foils, the cell base can be about 4.0 mm and the cell height about 1.3 mm. For 0.025 to 0.1 mm thick foils, a smaller cell structure could have a base of about 1.9 to about 2.2 mm, and a cell height of about 1.0 to about 1.1 mm. Alternatively, for 0.025 to 0.1 mm thick foils, an even smaller cell structure could have a base of about 1.4 to about 1.5 mm, and a cell height of about 0.7 to about 0.8 mm. For different applications, or different furnace sizes, the dimensions can be varied from the above.

Figure 2:
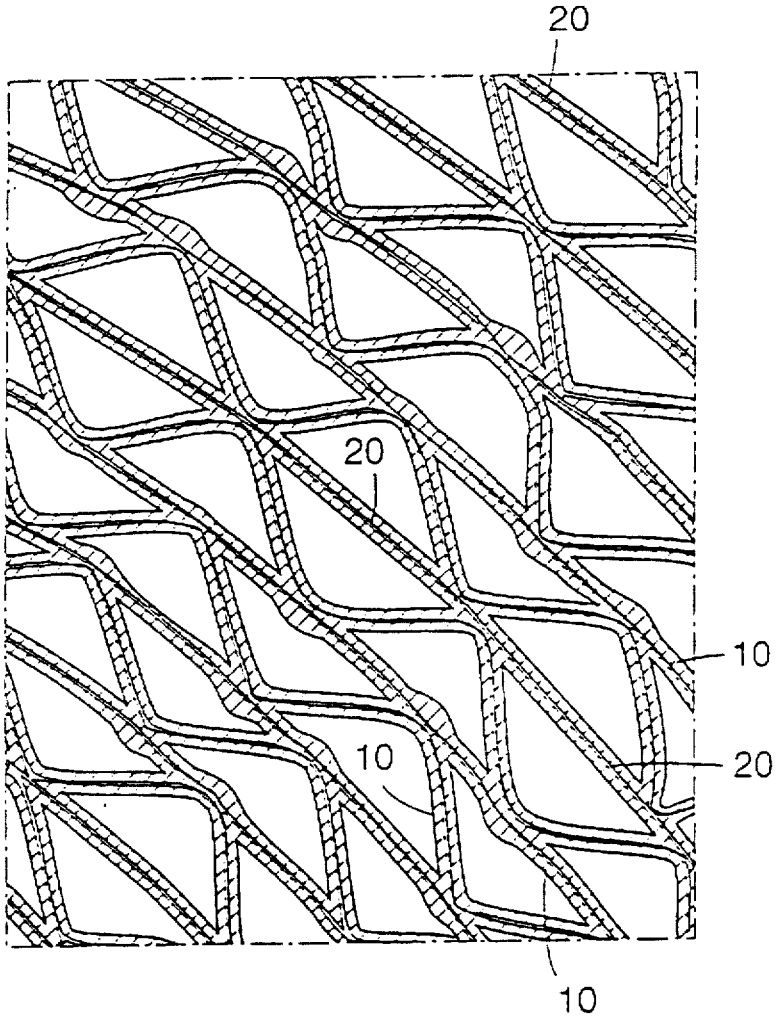
FIG. 2 is a cross-sectional view of an iron oxide structure of the invention shaped as a cylindrical flow divider.

The oxidative atmosphere should provide a sufficient supply of oxygen to permit transformation of iron to iron oxide. The particular oxygen amounts, source, concentration, and delivery rate can be adjusted according to the characteristics of the starting material, requirements for the final product, equipment used, and processing details. A simple oxidative atmosphere is air. Exposing both sides of a sheet of the structure permits oxidation to occur from both sides, thereby increasing the efficiency and uniformity of the oxidation process. Without wishing to be bound by theory, it is believed that oxidation of the iron in the starting structure occurs via a diffusional mechanism, most probably by diffusion of iron atoms from the metal lattice to a surface where they are oxidized. This mechanism is consistent with formation of an internal gap in the structure during the oxidation process. Where oxidation occurs from both sides of a sheet 10, the internal gap 20 can be seen in a cross-sectional view of the structure, as is shown in FIG. 2.

Where an iron structure contains regions which vary in their openness to air flow, internal gaps have been found to be wider in the most open regions of a structure, which suggests that oxidation may occur more evenly on both sides of the iron-containing structure than at other regions of the structure. In less open regions of the iron structure, particularly at points of contact between sheets of iron-containing structure, gaps have been found to be narrower or even not visible. Similarly, iron-containing wires can form hollow iron oxide tubes having a central cylindrical void analogous to the internal gap which can be found in iron oxide sheets.

When iron (atomic weight 55.85) is oxidized to $Fe_2O_3$ (molecular weight 159.69) or $Fe_3O_4$ (molecular weight 231.54), the oxygen content which comprises the theoretical weight gain is 30.05 percent or 27.64 percent, respectively, of the final product. Oxidation takes place in a significantly decreasing fashion over time. That is, at early times during the heating process, the oxidation rate is relatively high, but decreases significantly as the process continues. This is consistent with the diffusional oxidation mechanism believed to occur, since the length of the diffusion path for iron atoms would increase over time. The quantitative rate of hematite formation varies with factors such as the heating regime, and details of the iron-containing structure design, such as foil thickness, and cell size. For example, when an iron-containing structure made from flat and corrugated 0.1 mm thick plain steel foils, and having large cells as described above, is heated at about 850° C., more than forty percent of the iron can be oxidized in one hour. For such a structure, more than sixty percent of the iron can be oxidized in about four hours, while it can take about 100 hours for total (substantially 100 percent) oxidation of iron to hematite.

Impurities in the steel starting structures, such as P, Si, and Mn, may form solid oxides which slightly contaminate the final iron oxide structure. Further, the use of an asbestos insulating layer in the process of the invention can also introduce impurities in the iron oxide structure. Factors such as these can lead to an actual weight gain slightly more than the theoretical weight gain of 30.05 percent or 27.64 percent, respectively, for formation of hematite and magnetite. Incomplete oxidation can lead to a weight gain less than the theoretical weight gain of 30.05 percent or 27.64 percent, respectively, for formation of hematite and magnetite. Also, when magnetite is formed by de-oxidizing hematite, incomplete de-oxidation of hematite can lead to a weight gain of greater than 27.64 percent for formation of magnetite. Therefore, for practical reasons, the terms iron oxide structure, hematite structure, and magnetite structure, as used herein, refer to structures consisting substantially of iron oxide, hematite, and magnetite, respectively.

Oxygen content and x-ray diffraction spectra can provide useful indicators of formation of iron oxide structures of the invention from iron-containing structures. In accordance with this invention, the term hematite structure encompasses structures which at room temperature are substantially non-magnetic and substantially nonconductive electrically, and contain greater than about 29 weight percent oxygen. Typical x-ray diffraction data for hematite powder are shown in Table IV in Example 1 below. Magnetite structure refers to structures which at room temperature are magnetic and electrically conductive and contain about 27 to about 29 weight percent oxygen. If magnetite is formed by de-oxidation of hematite, hematite can also be present in the final structure as seen, for example in the x-ray data illustrated in Table V in Example 2 below. Depending on the desired characteristics and uses of the final product, de-oxidation can proceed until sufficient magnetite is formed.

It may be desirable to approach the stoichiometric oxygen content in the iron oxide present in the final structure. This can be accomplished by controlling such factors as heating rate, heating temperature, heating time, air flow, and shape of the iron-containing starting structure, as well as the choice and handling of an insulating layer.

Hematite formation preferably is brought about by heating a plain steel material at a temperature less than the melting point of iron (about 1536° C.), more preferably at a temperature less than about 1350° C., even more preferably at a temperature of about 725° to about 1200° C., and most preferably about 750° to about 850° C. Oxidation at temperatures below about 700° C. may be too slow to be practical in some instances, whereas oxidation or iron to hematite at temperatures above about 1400° C. may require careful control to avoid localized overheating and melting due to the strong exothermicity of the oxidation reaction.

The temperature at which iron is oxidized to hematite is inversely related to the surface area of the product obtained. For example, oxidation at about 750° to about 850° C. can yield a hematite structure having a BET surface area about four times higher than that obtained at 1200° C.

A suitable and simple furnace for carrying out the heating is a conventional convection furnace. Air access in a conventional convection furnace is primarily from the bottom of the furnace. Electrically heated metallic elements can be employed around the structure to be heated to provide relatively uniform heating to the structure, preferably within about 1° C. In order to provide a relatively uniform heating rate, an electronic control panel can be provided, which also can assist in providing uniform heating to the tube. It is not believed that any particular furnace design is critical so long as an oxidative environment and heating to the desired temperature are provided to the starting material.

The starting structure can be placed inside a jacket which can serve to fix the outer dimensions of the structure. For example, a cylindrical disk can be placed inside a cylindrical quartz tube which serves as a jacket. If a jacket is used for the starting structure, an insulating layer preferably is disposed between the outer surface of the starting structure and the inner surface of the jacket. The insulating material can be any material which serves to prevent the outer surface of the iron oxide structure formed during the oxidation process from welding to the inner surface of the jacket. Asbestos is a suitable insulating material.

For ease in handling, the starting structure may be placed into the furnace, or heating area, while the furnace is still cool. Then the furnace can be heated to the working temperature and held for the heating period. Alternatively, the furnace or heating area can be heated to the working temperature, and then the metal starting structure can be placed in the heating area for the heating period. The rate at which the heating area is brought up to the working temperature is not critical, and ordinarily will merely vary with the furnace design. For formation of hematite using a convection furnace at a working temperature of about 790° C., it is preferred that the furnace is heated to the working temperature over a period of about 24 hours, a heating rate of approximately 35° C. per hour.

The time for heating the structure (the heating period) varies with such factors as the furnace design, rate of air (oxygen) flow, and weight, wall thickness, shape, size, and open cross-section of the starting material. For example, for formation of hematite from plain steel foils of about 0.1 mm thickness, in a convection furnace, a heating time of less than about one day, and most preferably about 3 to about 5 hours, is preferred for cylindrical disk structures about 20 mm in diameter, about 15 mm high, and weighing about 5 grams. For larger samples, heating time should be longer. For example, for formation of hematite from such plain steel foils in a convection furnace, a heating time of less than about ten days, and most preferably about 3 to about 5 days, is preferred for disk structures about 95 mm in diameter, about 70 mm high, and weighing up to about 1000 grams.

After heating, the structure is cooled. Preferably, the heat is turned off in the furnace and the structure simply is permitted to cool inside the furnace under ambient conditions over about 12 to 15 hours. Cooling should not be rapid, in order to minimize any adverse effects on integrity and mechanical strength of the iron oxide structure. Quenching the iron oxide structure ordinarily should be avoided.

Monolithic hematite structures of the invention have shown remarkable mechanical strength, as can be seen in Tables III and VI in the Examples below. For hematite structures shaped as flow dividers, structures having smaller cell size and larger wall thickness exhibit the greatest strength. Of these two characteristics, as can be seen in Tables III and VI, the primary strength enhancement appears to stem from cell size, not wall thickness. Therefore, hematite structures of the invention are particularly desirable for use as light flow dividers having a large open cross-section.

A particularly promising application of monoliths of the invention is as a ceramic support in automotive catalytic converters. A current industrial standard is a cordierite flow divider having, without washcoating, a wall thickness of about 0.17 mm, an open cross-section of 65 percent, and a limiting strength of about 0.3 MPa. P. D. Strom et al., SAE Paper 900500, pgs. 40–41, "Recent Trends in Automotive Emission Control," SAE (February 1990). As can be seen in Tables I and III below, the present invention can be used to manufacture a hematite flow divider having thinner walls (approximately 0.07 mm), higher open cross-section (approximately 80 percent), and twice the limiting strength (approximately 0.5 to about 0.7 MPa) as compared to the cordierite product. Hematite flow dividers having thin walls, such as for example, 0.07 to about 0.3 mm may be obtained with the present invention.

The preferred method of forming magnetite structures of the invention comprises first transforming an iron-containing structure to hematite, as described above, and then de-oxidizing the hematite to magnetite. Following the oxidation of a starting structure to hematite, the hematite can be de-oxidized to magnetite by heating at about 1350° to about 1550° C. optionally, after heating to form a hematite structure, the structure can be cooled, such as to a temperature at or above room temperature, as desired for practical handling of the structure, prior to de-oxidation of hematite to magnetite. Alternatively, the hematite structure need not be cooled prior to de-oxidation to magnetite.

The heating time sufficient to de-oxidize hematite to magnetite generally is much shorter than the period sufficient to oxidize the material to hematite initially. Preferably, for use of hematite structures as described above, the heating time for de-oxidation to magnetite structures is less than about twenty-four hours, and in most cases is more preferably less than about six hours in order to form structures containing suitable magnetite. A heating time of less than about one hour for de-oxidation may be sufficient in many instances.

A simple de-oxidative atmosphere is air. Alternate useful de-oxidative atmospheres are nitrogen-enriched air, pure nitrogen (or any proper inert gas), or a vacuum. The presence of a reducing agent, such as carbon monoxide, can assist in efficiency of the de-oxidation reaction.

Magnetite structures also can be formed directly from iron-containing structures by heating iron-containing structures in an oxidative atmosphere. To avoid a substantial presence of hematite in the final product, the preferred working temperatures for a direct transformation of iron-containing structures to magnetite are about 1350 to about 1500° C. Since the oxidation reaction is strongly exothermic, there is a significant risk that the temperature in localized areas can rise above the iron melting point of approximately 1536° C., resulting in local melts of the structure. Since the de-oxidation of hematite to magnetite is endothermic, unlike the exothermic oxidation of steel to magnetite, the risk of localized melts is minimized if iron is first oxidized to hematite and then de-oxidized to magnetite. Thus, formation of a magnetite structure by oxidation of an iron-containing structure to a hematite structure at a temperature below about 1200° C., followed by de-oxidation of hematite to magnetite, is the preferred method.

Thin-walled iron-oxide structures of the invention can be used in a wide variety of applications. The relatively high open cross-sectional area which can be obtained can make the products useful as catalytic supports, filters, thermal insulating materials, and sound insulating materials.

Iron oxides of the invention, such as hematite and magnetite, can be useful in applications such as gaseous and liquid flow dividers; corrosion resistant components of automotive exhaust systems, such as mufflers, catalytic converters, etc.; construction materials (such as pipes, walls, ceilings, etc.); filters, such as for water purification, food products, medical products, and for particulates which may be regenerated by heating; thermal insulation in high-temperature environments (such as furnaces) and/or in chemically corrosive environments; and sound insulation. Iron oxides of the invention which are electrically conductive, such as magnetite, can be electrically heated and, therefore, can be applicable in applications such as electrically heated thermal insulation, electric heating of liquids and gases passing through channels, and incandescent devices. Additionally, combination structures using both magnetite and hematite can be fabricated. For example, it should be possible for the materials of the invention to be combined in a magnetite heating element surrounded by hematite insulation.

The following examples are illustrative of the invention.

EXAMPLE 1

Monolithic hematite structures in the shape of a cylindrical flow divider were fabricated by heating a structure made from plain steel in air, as described below. Five different steel structure samples were formed, and then transformed to hematite structures. Properties of the structures and processing conditions for the five runs are set forth in Table I.

TABLE I

FLOW DIVIDER PROPERTIES AND PROCESSING CONDITIONS

| | 1 | 2 | 3 | 4 | 5 |
|---|---|---|---|---|---|
| Steel Disk Diameter, mm | 92 | 52 | 49 | 49 | 49 |
| Steel Disk Height, mm | 76 | 40 | 40 | 40 | 40 |
| Steel Disk Vol., $cm^3$ | 505.2 | 84.9 | 75.4 | 75.4 | 75.4 |
| Steel foil thickness, mm | 0.025 | 0.1 | 0.051 | 0.038 | 0.025 |
| Cell base, mm | 2.15 | 1.95 | 2.00 | 2.05 | 2.15 |
| Cell height, mm | 1.07 | 1.00 | 1.05 | 1.06 | 1.07 |
| Steel wt., g | 273.4 | 162.0 | 74.0 | 62.3 | 46.0 |
| Steel sheet length, cm | 1714 | 446 | 450 | 458 | 480 |
| Steel area (one side), $cm^2$ | 13920 | 1784 | 1800 | 1832 | 1920 |
| Steel volume, $cm^3$* | 34.8 | 20.6 | 9.4 | 7.9 | 5.9 |
| Steel disk open, cross-section, % | 93 | 76 | 87 | 89 | 92 |
| Heating time, hr. | 96 | 120 | 96 | 96 | 96 |
| Heating temp., °C. | 790 | 790 | 790 | 790 | 790 |
| Hematite wt., g | 391.3 | 232.2 | 104.3 | 89.4 | 66.1 |
| Hematite weight gain, wt. % | 30.1 | 30.2 | 29.1 | 30.3 | 30.3 |

TABLE I-continued

FLOW DIVIDER PROPERTIES AND PROCESSING CONDITIONS

| | 1 | 2 | 3 | 4 | 5 |
|---|---|---|---|---|---|
| Typical actual hematite thickness, mm | 0.072 | 0.29 | 0.13 | 0.097 | 0.081 |
| Typical hematite gap, mm | 0.015 | 0.04 | 0.02 | 0.015 | 0.015 |
| Typical hematite thickness without gap, mm | 0.057 | 0.25 | 0.11 | 0.082 | 0.066 |
| Hematite vol. without gap, $cm^3$* | 74.6 | 44.3 | 19.9 | 17.1 | 12.6 |
| Actual hematite vol. with gap, $cm^3$** | 93.8 | 51.7 | 23.4 | 20.1 | 15.6 |
| Hematite structure open cross-section without gap, % | 85 | 48 | 73 | 77 | 83 |
| Actual open cross-section with gap, % | 81 | 39 | 69 | 73 | 79 |

*Calculated from the steel or hematite weight using a density of 7.86 $g/cm^3$ for steel and 5.24 $g/cm^3$ for hematite

**Calculated as the product of (one-sided) steel geometric area times actual hematite thickness (with gap)

Details of the process carried out for Sample 1 are given below. Samples 2 to 5 were formed and tested in a similar fashion.

For Sample 1, a cylindrical flow divider similar to that depicted in FIG. 1, measuring about 92 mm in diameter and 76 mm in height, was constructed from two steel sheets, each 0.025 mm thick AISI-SAE 1010, one flat and one corrugated. The corrugated sheet of steel had a triangular cell, with a base of 2.15 mm and a height of 1.07 mm. The sheets were wound tightly enough so that physical contact was made between adjacent flat and corrugated sheets. After winding, an additional flat sheet of steel was placed around the outer layer of the structure to provide ease in handling and added rigidity. The final weight of the structure was about 273.4 grams.

The steel structure was wrapped in an insulating sheet of asbestos approximately 1 mm thick, and tightly placed in a cylindrical quartz tube which served as a jacket for fixing the outer dimensions of the structure. The tube containing the steel structure was then placed at room temperature on a ceramic support in a convection furnace. The ceramic support retained the steel sample at a height in the furnace which subjected the sample to a uniform working temperature varying by no more than about 1° C. at any point on the sample. Thermocouples were employed to monitor uniformity of sample temperature.

After placing the sample in the furnace, the furnace was heated electrically for about 22 hours at a heating rate of about 35° C. per hour, to a working temperature of about 790° C. The sample was then maintained at about 790° C. for about 96 hours in an ambient air atmosphere. No special arrangements were made to affect air flow within the furnace. After about 96 hours, heat in the furnace was turned off, and the furnace permitted to cool to room temperature over a period of about 20 hours. Then, the quartz tube was removed from the furnace.

The iron oxide structure was separated easily from the quartz tube, and traces of the asbestos insulation were mechanically removed from the iron oxide structure by abrasive means.

The structure weight was about 391.3 grams, corresponding to a weight gain (oxygen content) of about 30.1 weight percent. The very slight weight increase above the theoretical limit of 30.05 percent was believed to be due to impurities which may have resulted from the asbestos insulation. X-ray diffraction spectra for a powder made from the structure demonstrated excellent agreement with a standard hematite spectra, as shown in Table IV. The structure generally retained the shape of the steel starting structure, with the exception of some deformations of triangular cells due to increased wall thickness. In the hematite structure, all physical contacts between adjacent steel sheets were internally "welded," producing a monolithic structure having no visible cracks or other defects. The wall thickness of the hematite structure was about 0.07 to about 0.08 mm, resulting in an open cross-section of about 80 percent, as shown in Table I. In various cross-sectional cuts of the structure, which as viewed under a microscope each contained several dozen cells, an internal gap of about 0.01 to about 0.02 mm could almost always be seen. The BET surface area was about 0.1 $m^2$/gram.

The hematite structure was nonmagnetic, as checked against a common magnet. In addition, the structure was not electrically conductive under the following test. A small rod having a diameter of about 5 mm and a length of about 10 mm was cut from the structure. The rod was contacted with platinum plates which served as electrical contacts. Electric power capable of supplying about 10 to about 60 watts was applied to the structure without any noticeable effect on the structure.

The monolithic hematite structure was tested for sulfur resistance by placing four samples from the structure in sulfuric acid (five and ten percent water solutions) as shown below in Table II. Samples 1 and 2 included portions of the outermost surface sheets. It is possible that these samples contained slight traces of insulation, and/or were incompletely oxidized when the heating process was ceased. Samples 3 and 4 included internal sections of the structure only. With all four samples, no visible surface corrosion of the samples was observed, even after 36 days in the sulfuric acid, and the amount of iron dissolved in the acid, as measured by standard atomic absorption spectroscopy, was negligible. The samples also were compared to powder samples made from the same monolithic hematite structure, ground to a similar quality as that used for x-ray diffraction analyses, and soaked in $H_2SO_4$ for about twelve days. After another week of exposure (for a total of 43 days for the monolith samples and 19 days for the powder samples), the amount of dissolved iron remained virtually unchanged, suggesting that the saturation concentrations had been reached. Relative dissolution for the powder was higher due to the surface area of the powder samples being higher than that of the monolithic structure samples. However, the amount and percentage dissolution were negligible for both the monolithic structure and the powder formed from the structure.

TABLE II

RESISTANCE TO CORROSION FROM SULFURIC ACID

| | Sample 1 | Sample 2 | Sample 3 | Sample 4 |
|---|---|---|---|---|
| wt. $Fe_2O_3$, g | 14.22 | 16.23 | 13.70 | 12.68 |
| wt. Fe, g | 9.95 | 11.36 | 9.59 | 8.88 |
| % $H_2SO_4$ | 5 | 10 | 5 | 10 |
| wt Fe dissolved, mg, 8 days | 4.06 | 4.60 | 1.56 | 2.19 |
| wt Fe dissolved, mg, 15 days | 5.54 | 5.16 | 2.40 | 3.43 |
| wt Fe dissolved, mg, 36 days | 6.57 | 7.72 | 4.12 | 4.80 |
| total wt % Fe dissolved, 36 days | 0.066 | 0.068 | 0.043 | 0.054 |
| total wt % Fe dissolved, 12 days, from powder | 0.047 | 0.047 | 0.041 | 0.046 |

Based on the data given in Tables I and II for the monolithic structure, the average corrosion resistance for the samples was less than 0.2 mg/cm$^2$ yr, which is considered non-corrosive by ASM. ASM Engineered Materials Reference Book, ASM International, Metals Park, Ohio 1989.

Figure 3:
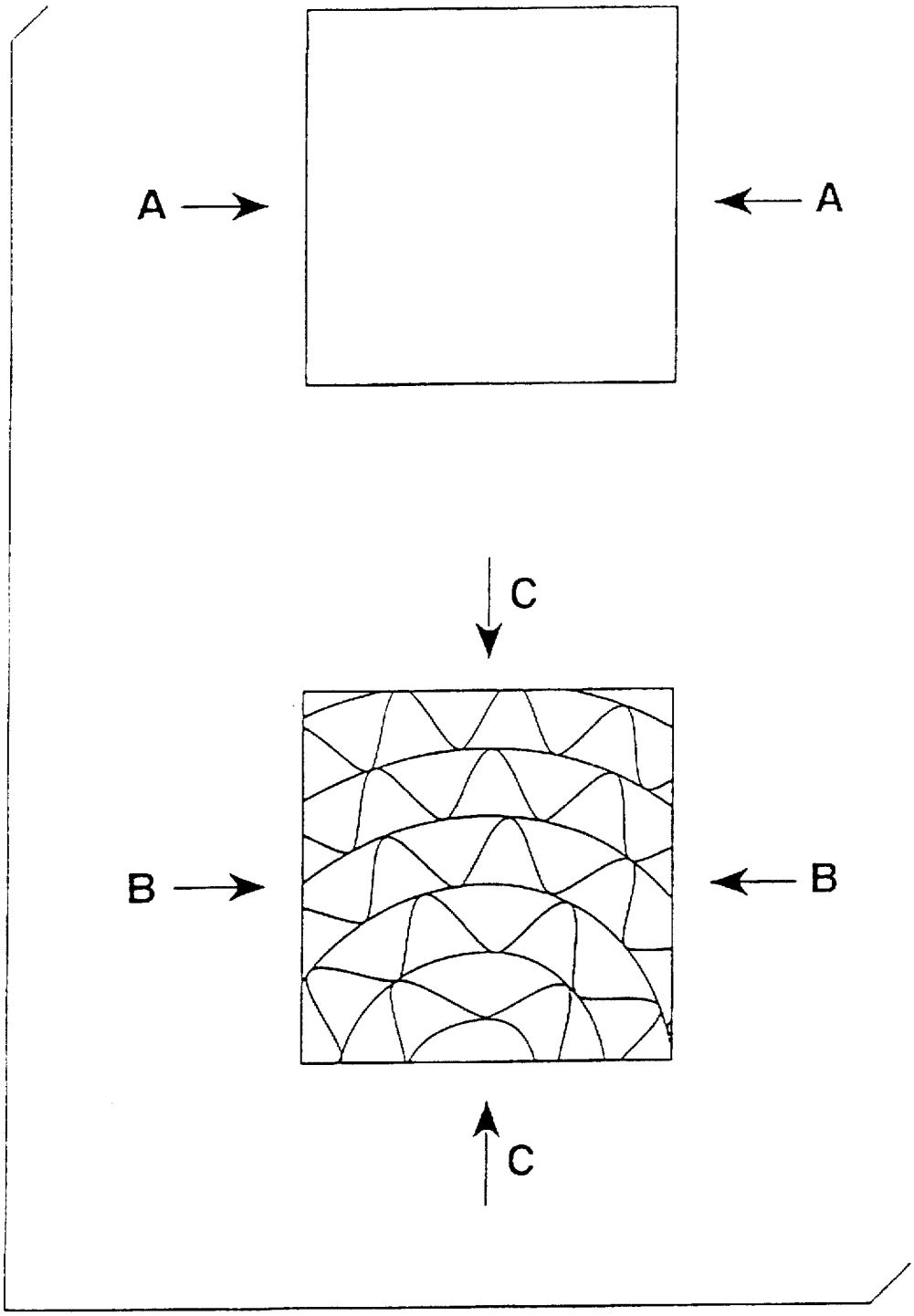
FIG. 3 is a schematic cross-sectional view of a cubic sample of an iron oxide structure of the invention shaped as a cylindrical flow divider, with the coordinate axes and direction of forces shown.

The hematite structure of the example also was subjected to mechanical crush testing, as follows. Seven standard cubic samples, each about 1"×1"×1" were cut by a diamond saw from the structure. FIG. 3 depicts a schematic cross-sectional view of the samples tested, and the coordinate axes and direction of forces. Axis A is parallel to the channel axis, axis B is normal to the channel axis and quasi-parallel to the flat sheet, and axis C is normal to the channel axis and quasi-normal to the flat sheet. The crush pressures are given in Table III.

TABLE III

MECHANICAL STRENGTH OF HEMATITE MONOLITHS

| SAMPLE | AXIS TESTED | CRUSH PRESSURE MPa |
|---|---|---|
| 1 | a | 24.5 |
| 2 | b | 1.1 |
| 3 | c | 0.6 |
| 4 | c | 0.5 |
| 5 | c | 0.7 |
| 6 | c | 0.5 |
| 7 | c | 0.5 |

Sample 4 from Table I also was characterized using an x-ray powder diffraction technique. Table IV shows the x-ray (Cu $K_\alpha$ radiation) powder spectra of the sample as measured using an x-ray powder diffractometer HZG-4 (Karl Zeiss), in comparison with standard diffraction data for hematite. In the Table, "d" represents interplanar distances and "J" represents relative intensity.

TABLE IV

X-RAY POWDER DIFFRACTION PATTERNS FOR HEMATITE

| SAMPLE | | STANDARD | |
|---|---|---|---|
| d, A | J, % | d, A* | J, %* |
| 3.68 | 19 | 3.68 | 30 |
| 2.69 | 100 | 2.70 | 100 |
| 2.52 | 82 | 2.52 | 70 |
| 2.21 | 21 | 2.21 | 20 |
| 1.84 | 43 | 1.84 | 40 |
| 1.69 | 52 | 1.69 | 45 |

*Data file 33-0664, The International Centre for Diffraction Data, Newton Square, Pa.

EXAMPLE 2

A monolithic magnetite structure was fabricated by de-oxidizing a monolithic hematite structure. The magnetite structure substantially retained the shape, size, and wall thickness of the hematite structure from which it was formed.

The hematite structure was made according to a process substantially similar to that set forth in Example 1. The steel foil from which the hematite flow divider was made was about 0.1 mm thick. The steel structure was heated in a furnace at a working temperature of about 790° C. for about 120 hours. The resulting hematite flow divider had a wall thickness of about 0.27 mm, and an oxygen content of about 29.3 percent.

A substantially cylindrical section of the hematite structure about 5 mm in diameter, about 12 mm long, and weighing about 646.9 milligrams was cut from the hematite flow divider along the axial direction for making the magnetite structure. This sample was placed in an alundum crucible and into a differential thermogravimetric analyzer TGD7000 (Sinku Riko, Japan) at room temperature. The sample was heated in air at a rate of about 10° C. per minute up to about 1460° C. The sample gained a total of about 1.2 mg weight (about 0.186%) up to a temperature of about 1180° C., reaching an oxygen content of about 29.4 weight percent. From about 1180° C. to about 1345° C., the sample gained no measurable weight. At temperatures above about 1345° C., the sample began losing weight. At about 1420° C., a strong endothermic effect was seen on a differential temperature curve of the spectrum. At 1460° C., the total weight loss compared to the hematite starting structure was about 9.2 mg. The sample was kept at about 1460° C. for about 45 minutes, resulting in an additional weight loss of about 0.6 mg, for a total weight loss of about 9.8 mg. Further heating at 1460° C. for approximately 15 more minutes did not affect the weight of the sample. The heat was then turned off, the sample allowed to cool slowly (without quenching) to ambient temperature over several hours, and then removed from the analyzer.

The oxygen content of the final product was about 28.2 weight percent. The product substantially retained the shape and size of the initial hematite sample, particularly in wall thickness and internal gaps. By contrast to the hematite sample, the final product was magnetic, as checked by an ordinary magnet, and electrically conductive. X-ray powder spectra, as shown in Table V, demonstrated characteristic peaks of magnetite along with several peaks characteristic of hematite.

The structure was tested for electrical conductivity by cleaning the sample surface with a diamond saw, contacting the sample with platinum plates which served as electrical contacts, and applying electric power of from about 10 to about 60 watts (from a current of about 1 to about 5 amps, and a potential of about 10 to about 12 volts) to the structure over a period of about 12 hours. During the testing time, the rod was incandescent, from red-hot (on the surface) to white-hot (internally) depending on the power being applied.

Table V shows the x-ray (Cu $K_\alpha$ radiation) powder spectra of the sample as measured using an x-ray powder diffractometer HZG-4 (Karl Zeiss), in comparison with standard diffraction data for magnetite. In the Table, "d" represents interplanar distances and "J" represents relative intensity.

TABLE V

X-RAY POWDER DIFFRACTION PATTERNS FOR MAGNETITE

| SAMPLE | | STANDARD | |
|---|---|---|---|
| d, A | J, % | d, A* | J, %* |
| 2.94 | 20 | 2.97 | 30 |
| 2.68** | 20 | | |
| 2.52 | 100 | 2.53 | 100 |
| 2.43 | 15 | 2.42 | 8 |
| 2.19** | 10 | | |
| 2.08 | 22 | 2.10 | 20 |
| 1.61 | 50 | 1.62 | 30 |
| 1.48 | 75 | 1.48 | 40 |
| 1.28 | 10 | 1.28 | 10 |

*Data file 19-0629, The International Centre for Diffraction Data, Newton Square, Pa.
**Peaks characteristic of hematite. No significant peaks other than those characteristic of either hematite or magnetite were observed.

EXAMPLE III

Two hematite flow dividers were fabricated from Russian plain steel 3 and tested for mechanical strength. The samples were fabricated using the same procedures set forth in Example 1. The steel sheets were about 0.1 mm thick, and both of the steel flow dividers had a diameter of about 95 mm and a height of about 70 mm. The first steel structure had a triangular cell base of about 4.0 mm, and a height of about 1.3 mm. The second steel structure had a triangular cell base of about 2.0 mm, and a height of about 1.05 mm. Each steel structure was heated at about 790° C. for about five days. The weight gain for each structure was about 29.8 weight percent. The wall thickness for each of the final hematite structures was about 0.27 mm.

The hematite structures were subjected to mechanical crush testing as described in Example 1. Cubic samples as shown in FIG. 3, each about 1"×1"×1", were cut by a diamond saw from the structures. Eight samples were taken from the first structure, and the ninth sample was taken from the second structure. The crush pressures are shown in Table VI.

TABLE VI

MECHANICAL STRENGTH OF HEMATITE MONOLITHS

| SAMPLE | AXIS TESTED | CRUSH PRESSURE MPa |
|---|---|---|
| 1 | a | 24.0 |
| 2 | a | 32.0 |
| 3 | b | 1.4 |
| 4 | b | 1.3 |
| 5 | c | 0.5 |
| 6 | c | 0.75 |
| 7 | c | 0.5 |
| 8 | c | 0.5 |
| 9 | c | 1.5 |

What is claimed is:

1. A monolithic flow divider consisting essentially of an iron oxide selected from the group consisting of hematite, magnetite, and a combination thereof, and having a wall thickness less than about one millimeter.

2. A monolithic flow divider according to claim 1, wherein the wall thickness is about 0.07 to about 0.3 mm.

* * * * *